US011279445B2

(12) United States Patent
Michaeli et al.

(10) Patent No.: US 11,279,445 B2
(45) Date of Patent: Mar. 22, 2022

(54) MODULAR CARGO BAY CANOPY

(71) Applicant: Ockerman Automation Consulting, Inc., Anacortes, WA (US)

(72) Inventors: Jennifer Michaeli, Smithfield, VA (US); Robert Walling, Pine Beach, NJ (US); Alden Nelson, Norfolk, VA (US)

(73) Assignee: Ockerman Automation Consulting, Inc., Anacortes, WA (US)

( * ) Notice: Subject to any disclaimer, the term of this patent is extended or adjusted under 35 U.S.C. 154(b) by 103 days.

(21) Appl. No.: 16/825,792

(22) Filed: Mar. 20, 2020

(65) Prior Publication Data

US 2021/0291935 A1 Sep. 23, 2021

(51) Int. Cl.

| | |
|---|---|
| ***B63B 17/02*** | (2006.01) |
| ***B63B 3/08*** | (2006.01) |
| ***B63B 19/08*** | (2006.01) |
| ***B63B 3/48*** | (2006.01) |

(52) U.S. Cl.

CPC ..... *B63B 17/02* (2013.01); *B63B 3/08* (2013.01); *B63B 3/48* (2013.01); *B63B 19/08* (2013.01); *B63B 2017/026* (2013.01)

(58) Field of Classification Search

CPC .... B63B 3/00; B63B 3/08; B63B 3/48; B63B 17/00; B63B 17/02; B63B 2017/026; B63B 19/00; B63B 19/08; B63B 3/16; B63B 2019/0053; B63B 19/12; B63B 19/14

USPC ..... 114/56.1, 61.1, 116, 117, 118, 119, 120, 114/339, 343, 361, 364

See application file for complete search history.

(56) References Cited

U.S. PATENT DOCUMENTS

| | | | | |
|---|---|---|---|---|
| 2,356,392 | A | 8/1944 | Fluor | |
| 3,367,349 | A | 2/1968 | Olink | |
| 3,796,176 | A | 3/1974 | Garcia | |
| 4,476,798 | A | 10/1984 | Backus | |
| 5,044,298 | A | 9/1991 | Pepper et al. | |
| 7,249,568 | B1 | 7/2007 | Cultrara | |
| 7,270,075 | B1 * | 9/2007 | Jones | B63B 17/02 114/361 |
| 7,373,897 | B2 * | 5/2008 | Tufte | B63B 17/02 114/361 |
| 7,506,604 | B1 | 3/2009 | Cooper et al. | |
| 7,520,240 | B2 * | 4/2009 | Tufte | B63B 17/02 114/361 |

OTHER PUBLICATIONS

International Search Report and Written Opinion for PCT Application No. PCT/US2021/023236, dated Jun. 8, 2021.

* cited by examiner

*Primary Examiner* — Daniel V Venne
(74) *Attorney, Agent, or Firm* — Dorsey & Whitney LLP

(57) ABSTRACT

Described herein are examples of a watercraft with a hull defining a hull cavity. A canopy may be removably coupled to the hull via a canopy interface. The canopy interface includes a first portion fixed to the hull and a second portion fixed to the canopy. The first portion defines an opening through the hull into the hull cavity. The second portion is configured to be removably coupled to the first portion to enclose and seal the opening whereby the canopy interface is configured to interchangeably couple any one of a plurality of different canopies including the canopy to the hull. Each canopy of the plurality of different canopies may include a different configuration that provides a different access opening into the hull cavity or reconfigures the hull with a different outer profile.

20 Claims, 8 Drawing Sheets

MODULAR CARGO BAY CANOPY

BACKGROUND

Marine vehicles are typically purpose-built for certain types of cargoes or payloads. In a military setting, many boats benefit from having as small a profile as possible to avoid detection. Additionally, on all vessels, any protrusions or topside appendages can \ impact safety, air drag, and aesthetics. For a variety of operations, the cargoes or payloads of a vessel may be concealed beneath a canopy to reduce the visibility of the cargo, reduce air drag, and further protect the cargo from the harsh weather and marine environment. Crews may struggle to adapt multiple types and sizes of payloads to fit within marine vessels or boats with fixed canopies. For example, a boat adapted to work as a landing craft to deploy a land vehicle would require an overly large or complex fixed canopy than would not be required for a different cargo such a troop transport. Likewise, a boat adapted to carry may not be able to accommodate a vehicle or waterborne payload within its cargo hold. There is therefore a need for a boat with a flexible, modular cargo bay canopy system that can accommodate multiple types of cargoes while meeting the vessel's operational requirements for observability, safety, efficiency, and aesthetics.

SUMMARY

Described herein are examples of a watercraft with a hull defining a hull cavity. A canopy may be removably coupled to the hull via a canopy interface. The canopy interface includes a first portion fixed to the hull and a second portion fixed to the canopy. The first portion defines an opening through the hull into the hull cavity. The second portion is configured to be removably coupled to the first portion to enclose and seal the opening whereby the canopy interface is configured to interchangeably couple any one of a plurality of different canopies including the canopy to the hull. Each canopy of the plurality of different canopies may include a different configuration that provides a different access opening into the hull cavity or reconfigures the hull with a different outer profile. For example, a first one of the different modular canopies may include a first access opening and a second one of the different modular canopies may include a second access opening that is different from the first access opening (e.g., having a different size, and/or a different door system). In some embodiments, the different modular removable canopies may have outer surfaces that define different hull profiles such that by interchanging one modular canopy with another, the outer profile of the watercraft may be varied.

In some embodiments, the canopy is adapted to accommodate cargo that rises vertically above the first portion when the cargo is disposed within the hull cavity. In some embodiments, the canopy is adapted to accommodate cargo that is vertically below the first portion when the cargo is disposed within the hull cavity. In some embodiments, the canopy rises vertically above an upper surface of a command deck of the watercraft. In some embodiments, the canopy rises vertically below an upper surface of a command deck of the watercraft. In some embodiments, the canopy is adapted to accommodate a person. In some embodiments, the canopy is adapted to accommodate a wheeled vehicle.

In some embodiments, the second portion includes a canopy mating face, and the first portion includes a hull mating face. The canopy mating face is adapted for complementary engagement with the hull mating face when the canopy is installed on the watercraft. The hull mating face may include an indexing protrusion and a sealing gland. A resilient sealing element may be received in the sealing gland, and the canopy mating face may include an indexing recess and a sealing protrusion. In some embodiments, when the canopy is installed on the watercraft, the indexing protrusion may be received in the indexing recess to locate the canopy relative to the hull. The sealing protrusion may be received in the sealing gland and compress the resilient sealing element to seal the hull cavity from environmental contaminants when the canopy is installed on the watercraft. For example, the seal may be fluid-tight to keep out water, air, or other fluids. In some embodiments, the watercraft includes an air management system adapted to direct intake air to an engine room of the watercraft.

In some embodiments, the watercraft includes a first cargo door to selectively seal a cargo door opening defined within the canopy, and a door actuation system operable to selectively move the first cargo door between an open position and a closed position in which the first cargo door seals the first cargo door opening. The first cargo door may be adapted to allow a wheeled vehicle to pass through when the first cargo door is in the open position. In some embodiments, the watercraft includes a second cargo door and the door actuation system includes respective first and second hinges about which the first cargo door and the second cargo door are rotatable to move between respective open and closed positions. In some embodiments, the first cargo door and the second cargo door include respective internal edges that meet along a split line when the first and second cargo doors are in the closed position. In some embodiments, the door actuation system includes a track oriented along a longitudinal axis of the watercraft such that the first cargo door is slidable along the track between the open and closed positions. In some embodiments, the track is partially oriented along an upward axis of the watercraft such that the first cargo door is translatable about the upward axis between the open and closed positions.

In some embodiments, the second portion includes a metal interface and the first portion includes a metal interface. In some embodiments, the second portion includes a metal interface and the first portion includes a composite material interface. In some embodiments, the second portion includes a composite material interface and the first portion includes a metal interface. In some embodiments, the second portion includes a composite material interface and the first portion includes a composite material interface. In some embodiments, the canopy changes an internal volume of the hull cavity.

DETAILED DESCRIPTION

Figure 1A:
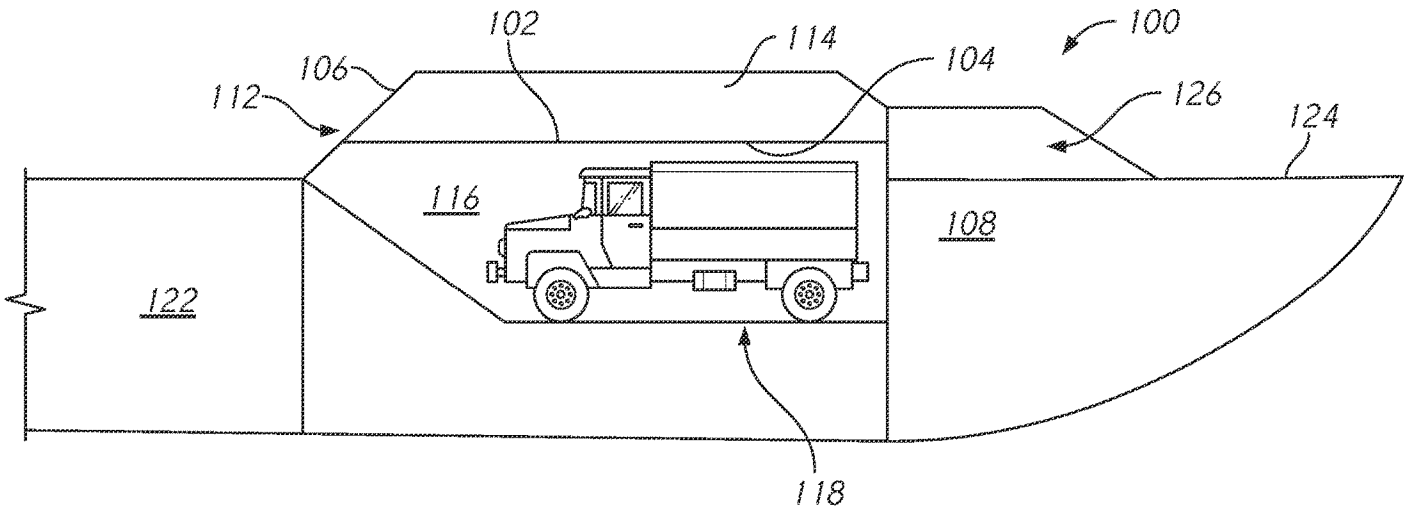
FIG. 1A shows a simplified elevation view of a boat with a tall modular cargo bay canopy.
Figure 1B:
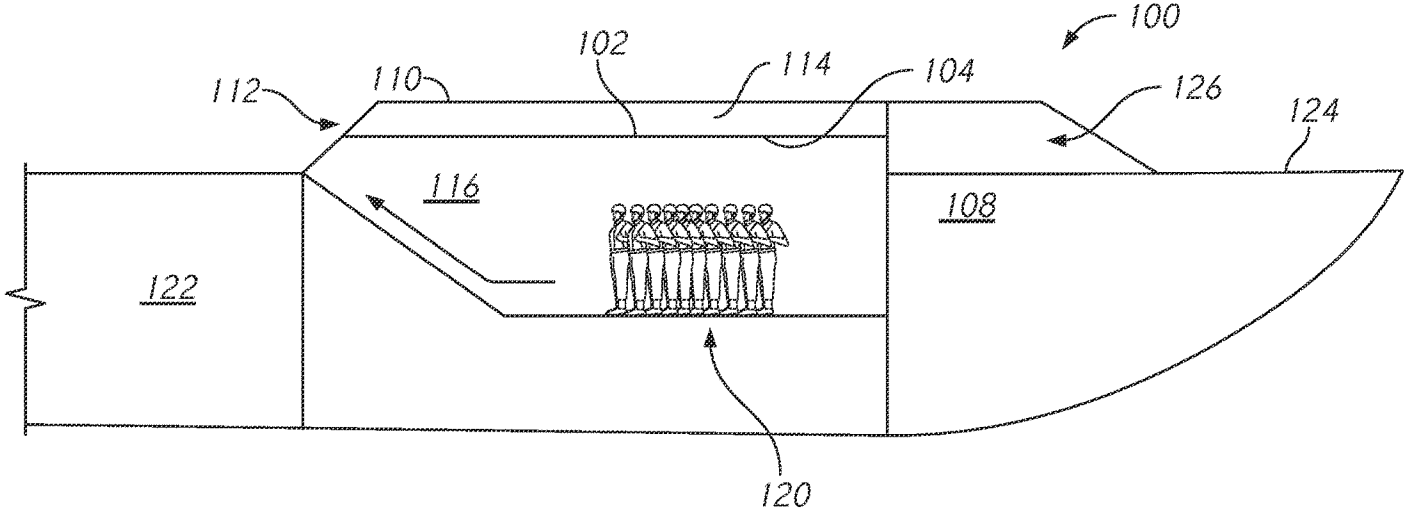
FIG. 1B shows a simplified elevation view of a boat with a short modular cargo bay canopy.

As seen schematically, for example in FIG. 1A and FIG. 1B, a watercraft, vessel, or boat 100 is shown with modular cargo bay canopies adapted for different payloads. In some embodiments, the watercraft or boat 100 may be a planing craft capable of traveling at speed in excess of Volume Froude Number 2.8. As such, in some embodiments, the watercraft or boat 100 may have a hull form suitable for operation or use as a planing hull (e.g., a V-hull). In some embodiments, the hull 108 may include multiple longitudinal hull portions, such as to provide a catamaran or any multi hull configuration, and one or more of the individual hull portions may have a V-shaped bottom profile. The boat 100 includes an internal hull cavity defined within the hull 108, which may provide a cargo bay 116. One or more of a plurality of different modular cargo bay canopies at least partially cover and seal the cargo bay 116 from the outside environment. The boat 100 includes a modular canopy interface 112 configured to interface with any one of the different modular cargo bay canopies to secure any one of the different canopies to the boat 100. The modular canopy interface 112 includes a first portion 104 associated with (e.g., fixedly coupled to) the hull 108 and a second portion 102 associated with (e.g., fixedly coupled to) one of a plurality of removable canopies. The first portion 104 may be referred to as a hull portion and the second portion 102 may be referred to as a canopy portion. The second portion 102 may be fixed to (e.g., fixedly coupled to or integrally-formed with, or unitary with) a removable canopy. The first portion 104 may be fixed to (e.g., fixedly coupled to or integrally-formed with, or unitary with) the boat 100, such as to the hull 108. The second portion 102 and first portion 104 cooperate to form the modular canopy interface 112 to secure a modular canopy to the boat 100, in some cases and forming a seal that may be fluid-tight (e.g., water-tight, and optionally but not necessarily air-tight). A seal for sealing (e.g., in a water-tight manner) various modular cargo bay canopies may be included at the modular canopy interface 112. The modular canopy interface 112 may be provided at or below a main deck 124 or at or below a command deck 126 of the boat 100.

The cargo bay 116 may be defined by one or more internal bulkheads and an internal deck. Situated aft of the cargo bay 116 is a portion of the internal hull cavity that may be, in some configurations, an engine room 122. Various other hull cavities may be defined within the hull 108, such as fuel tanks, ballast tanks, a command deck 126, crew cabins, and other cavities. The relative locations of the hull cavities are shown for example, and are in no way limiting. Other arrangements of hull cavities including the cargo bay 116, engine room 122, ballast tanks, and other cavities may be used as desired.

The cargo bay 116 is adapted to hold, secure, and/or transport a variety of different cargoes or payloads, such as a tall payload 118 or a short payload 120. The cargo bay 116 can be adapted to each payload as desired. For example, if the tall payload 118 is a vehicle, the cargo bay 116 may include tie down points to allow the vehicle to be secured to the internal walls or floor of the cargo bay 116 to prevent damage to the vehicle and/or the boat 100 from unwanted movement of the vehicle in the cargo bay 116 while the boat 100 is moving within a body of water. The cargo bay 116 may include an egress element, such as a ramp, elevator, ladder, or stairs to enable the payload to enter and exit the cargo bay 116. The ingress elements may be selectively removable from the cargo bay 116, for instance to adapt the cargo bay 116 to different missions or payloads.

In the configuration of FIG. 1A, the boat 100 has a tall cargo canopy 106 installed, to accommodate a tall payload 118, for example, a truck, tractor or other land vehicle; weapons or countermeasures system; drone (i.e., unmanned aerial, surface, or underwater vehicle) and associated deployment or recovery systems; or surveillance systems. A tall cargo canopy 106 canopy may be adapted to accommodate cargo that rises vertically above the first portion 104 when the cargo is disposed within the cargo bay 116. A tall cargo canopy 106 may rise vertically above an upper surface of a command deck 126 or a main deck of the boat 100. FIG. 1B shows the same boat 100 with a short cargo bay canopy 110 installed, to accommodate shorter payloads, such as a group of people, like troops or marines, or smaller vehicles like all-terrain vehicles, motorcycles, cars, or supplies. The short cargo bay canopy 110 may be adapted to accommodate cargo that is vertically below the modular first portion 104 when the cargo is disposed within the cargo bay 116. In some embodiments, modular cargo bay canopies can be adapted to include components of the above payloads, in addition to being adapted to conceal and protect the payloads themselves. In some embodiments, the modular canopy interface 112 can be adapted to accept interfaces to portions of the above payloads as well. For instance, rather than, or in addition to, installing a modular cargo bay canopy on the boat 100, a weapons system such as a missile launcher, fixed-wing drone deployment and recovery system, or the like could be installed on the boat 100 via the modular canopy interface 112.

The ability to adopt a short cargo bay canopy 110 when consistent with the payload or mission can have the advantage of reducing the visibility of the boat 100. For example, the short cargo bay canopy 110 modifies the profile of the boat 100 visually (e.g., the boat is smaller in profile) and may reduce the signature of the boat 100 to radar or other sensing technologies alternately or in addition to the visibility of the boat 100. By selecting a short cargo bay canopy 110 or a tall bay cargo canopy 106, the internal storage volume of the cargo bay 116 is modified (smaller or larger) as appropriate for the payload. Thus, the boat 100 can be adapted by way of different modular cargo bay canopies, to have the lowest observability characteristics, for a given payload. Another advantage of a boat 100 that can accept a modular cargo bay canopy, is that the boat 100 can be adapted for a variety of different missions, thereby increasing operational flexibility, while reducing cost. For example, it may be less costly to have one boat 100 with modular cargo bay canopies suited to five different missions, rather than five purpose-built boats.

Any of the modular cargo bay canopies disclosed herein may be provided as a thin shell formed by one or more intersecting canopy walls 114, or the roof or deck of a canopy. The shell may be in the form of shell plating. The canopy walls 114, canopy interfaces (either or both hull and canopy portions), and the hull 108 may be formed from any suitable material, such as metals like aluminum, steel, titanium, or alloys thereof; plastics such as thermoplastics or thermosets; composite materials such as fiber-reinforced composites that include a fiber (e.g., glass, carbon, aramid, or the like) surrounded by a matrix compound (e.g. polyester, PPS, epoxy, or the like); or combinations of these and other materials. Any modular cargo bay canopy may have a surface coating such as paint that modifies surface properties of the canopy, such as color, texture, observability characteristics, or reflectivity or absorbability of one or more wavelengths of electromagnetic radiation. In some embodiments, a modular cargo bay canopy can be transparent or translucent and may include windows or skylights to allow natural light into the cargo bay 116.

Figure 2:
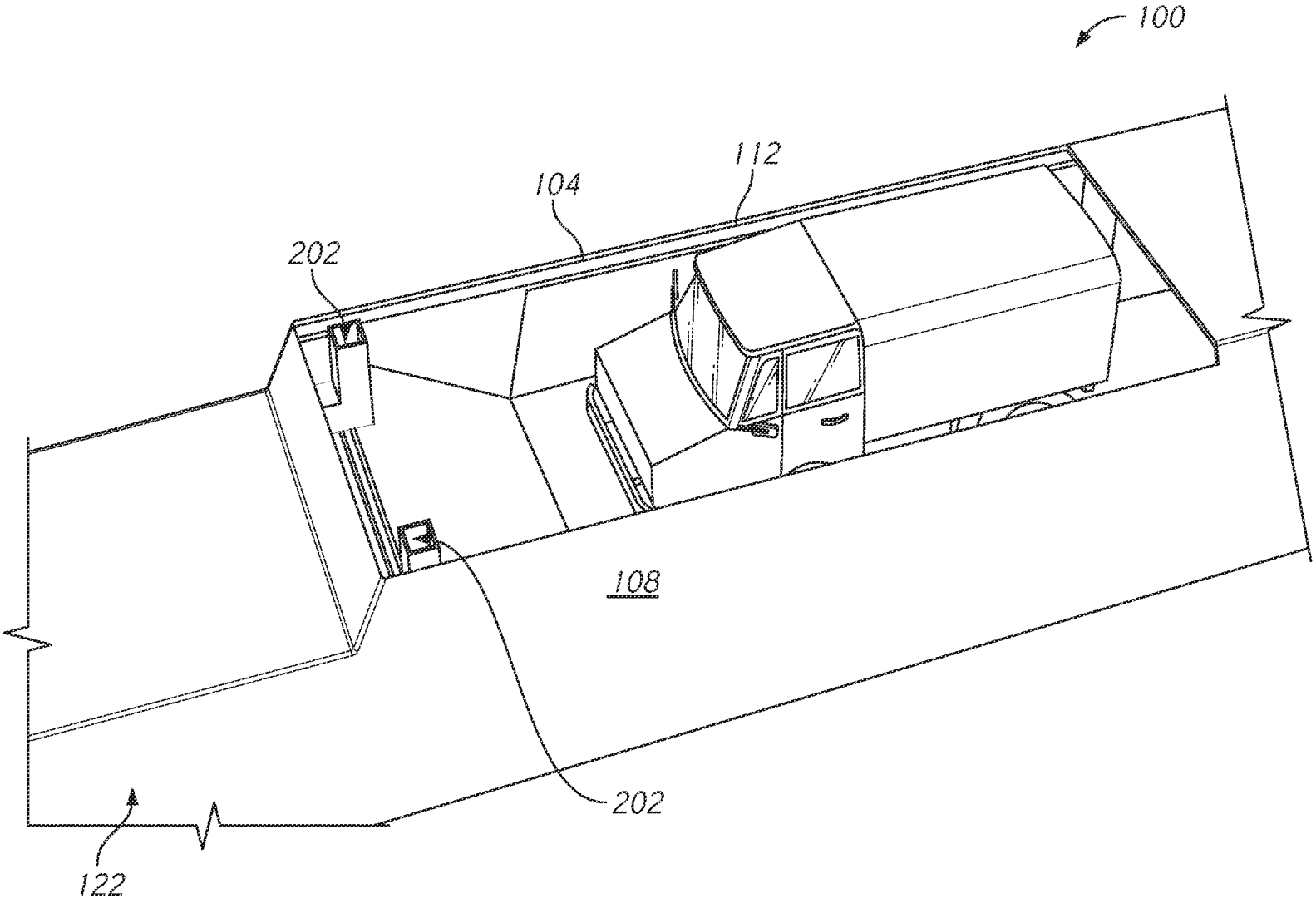
FIG. 2 shows an isometric view of a boat with a modular canopy interface adapted to receive multiple, different modular cargo bay canopies.

As shown in FIG. 2, the cargo bay 116 includes a modular canopy interface 112. The modular canopy interface 112 may be at least partially defined around an edge of the cargo bay 116, as shown. The modular canopy interface 112 may include edges that face upward from the boat 100, as well as edges that face laterally (across the boat 100, either athwartships, or longitudinally), and any suitable combinations thereof.

Figure 3:
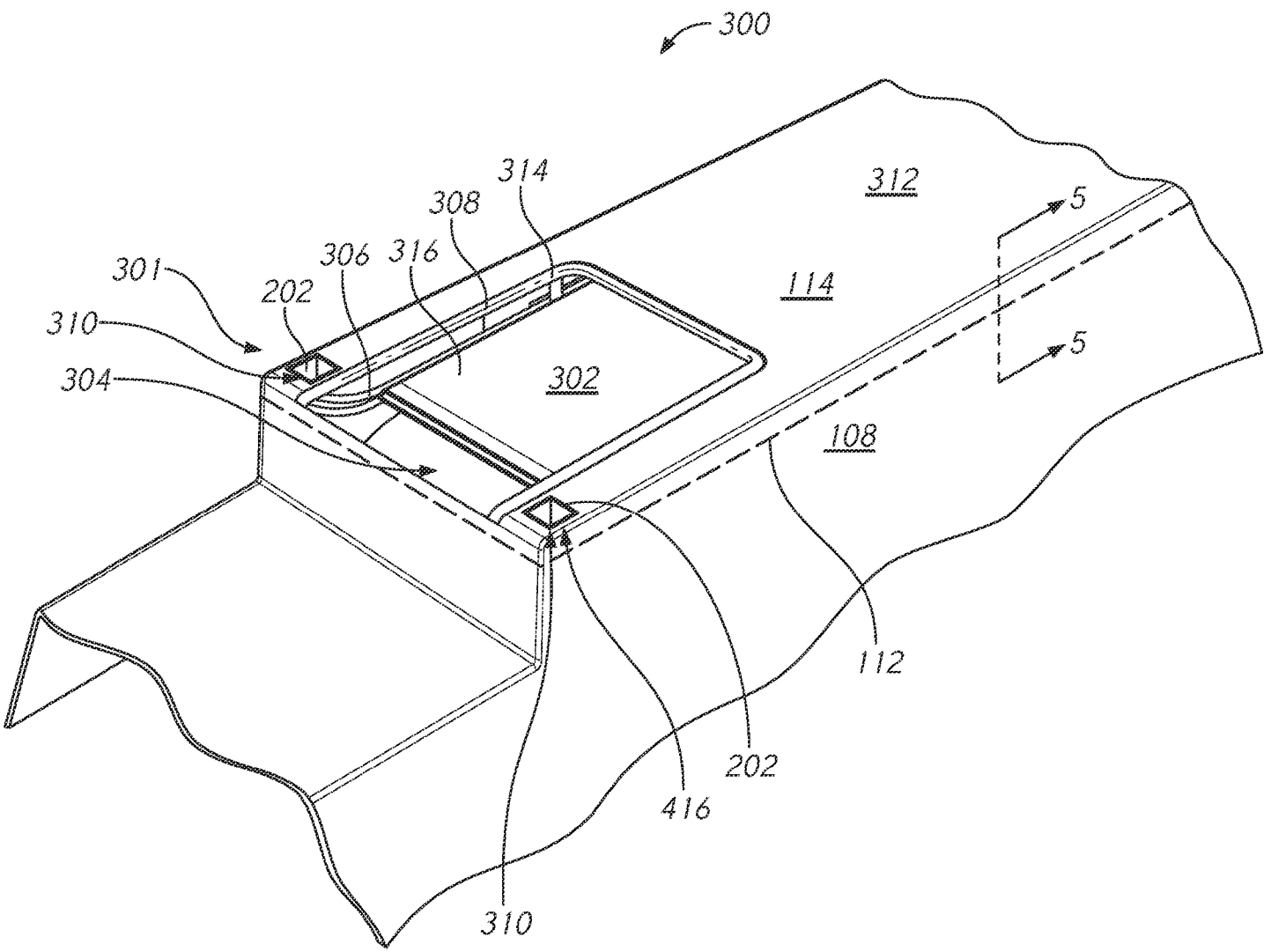
FIG. 3 shows a short modular cargo bay canopy with a cargo bay door in a partially open configuration.

A modular cargo bay canopy may include an auxiliary interface 301. For example, a modular cargo bay canopy according to any embodiment may include an auxiliary interface 301 including one or more air intakes 202. The air intake 202 may be adapted to draw air from outside the boat 100 and supply it to the engine room 122 for use as combustion and/or cooling air for a prime mover, such as an engine or other propulsion system. For example, FIG. 3 shows a short modular canopy 300 that includes an air intake management system 310 that aligns with the air intakes 202 to allow air to pass through the short modular canopy 300, and into the engine room 122, via the air intakes 202. It may be advantageous to direct intake air through an air intake management system 310 to place the air intake 202 at a high point on the boat 100 to decrease the risk of downflooding into the engine room 122, such as may be a risk when the boat 100 is in heavy seas, maneuvering aggressively, overloaded, or in a damage scenario (e.g., the boat 100 is listing).

In other embodiments, an auxiliary interface may be adapted to provide other functionality to the boat 100, or interface other equipment to the boat 100. For example, a modular cargo bay canopy may include an auxiliary interface to handle engine room exhaust; engine exhaust; a crew compartment; heating, ventilation, and/or air conditioning equipment, intakes, and/or exhausts; navigation equipment such as radar, forward-looking infrared sensors, navigation lights, or beacons; communications equipment such as antennae or the like; weapons or countermeasures; or other suitable equipment.

FIG. 3 shows an embodiment of a short modular canopy 300, such as may be adapted for use with smaller or shorter payloads. The short modular canopy 300 interfaces with the hull 108 of the boat 100 via the modular canopy interface 112 provided between the canopy wall 114 and the hull 108. The short modular canopy 300 includes a cargo door opening 304 defined by a cargo door jamb or coaming 308 provided as an internal edge in the canopy top 312 of the short modular canopy 300. The cargo door opening 304 may be selectively closeable by a canopy cargo door 302. The canopy cargo door 302 may enable a payload to enter or exit the cargo bay 116 without removing the short modular canopy 300. Other embodiments of modular cargo bay canopies disclosed herein may include any suitable variety of door, or may not include a door at all. In the example of FIG. 3, the canopy cargo door 302 includes a door actuation system that selectively opens and closes the canopy cargo door 302. In this embodiment, the door actuation system includes a cargo door track 306 situated at the port and starboard sides of the canopy cargo door 302. The canopy cargo door 302 is selectively moveable or slidable along the cargo door track 306. The cargo door track 306 may be oriented along a longitudinal axis of the boat 100 such that the canopy cargo door 302 is movable along the track between open and closed positions. A portion of the cargo door track 306 may be partially oriented along an upward axis of the boat 100 such that the canopy cargo door 302 is translatable about the upward axis between the open and closed positions.

In an open position, the canopy cargo door 302 may be retracted or rotated out of an ingress or egress path of a payload, such that the payload can enter or leave the cargo bay 116. A canopy cargo door can be in any number of positions between a fully open and a fully closed position. For instance, a canopy cargo door may be partially open to allow for increased ventilation into the cargo bay 116. In a closed position, a canopy cargo door, such as the canopy cargo door 302, may be sealed against ingress of contaminants or matter from the outside environment. For example, the cargo door coaming 308 and an edge of the canopy cargo door 302 may provide a respective opening sealing interface 314 and a door sealing interface 316 that cooperate to seal and/or align the canopy cargo door 302 with the cargo door coaming 308 to selectively seal the cargo door opening 304 against environmental contaminants (e.g., dirt, water, precipitation, birds, and the like), and/or to close off open areas in the cargo door opening 304 that can contribute to an increased observability profile of the boat 100. The seal interface of any door, (e.g. the opening sealing interface 314 and or door sealing interface 316) disclosed herein may include elements similar to the elements of the modular canopy interfaces described below with respect to FIG. 5A-FIG. 8B.

When moving between open and closed positions, the canopy cargo door 302 may roll along the cargo door track 306 by way of casters, wheels, or rollers situated in relation to the track, and rotatably attached to the canopy cargo door 302, such as by an axle, bearing, bushing, or the like. In other embodiments, the canopy cargo door 302 may slide or glide along the cargo door track 306. For instance, a portion of the canopy cargo door 302 may be situated within a portion of the cargo door track 306. The canopy cargo door 302 may be made of a single piece of material, or can be formed from hinged or joined sections such as plates.

The motion of the canopy cargo door 302 between open and closed positions may be effectuated by an actuator. "Actuator" refers to any device or machine that can move a door (or assist a person to move a door) between open and closed positions, for example, a power screw; belt; pneumatic, hydraulic, or electrically driven linear or rotary mechanism or motor; a solenoid; a spring; a handle for manual operation; or any suitable combinations of these. An actuator may be manually actuated, or may be automatically actuated, such as by a computer, processing element or other automated system, either on the boat 100, or off of the boat 100 and in communication therewith. For example, a power screw may be driven by an electric motor to move the canopy cargo door 302 along the cargo door track 306. As the canopy cargo door 302 moves from an open position to a closed position, the canopy cargo door 302 may move substantially longitudinally with respect to the boat 100 along the cargo door track 306. When the canopy cargo door 302 reaches a nearly closed position, the cargo door track 306 may divert or bend upward, such that a portion of the canopy cargo door 302 translates upwardly toward a canopy top 312 while continuing to move longitudinally. The canopy cargo door 302 may align with the canopy top 312. In some embodiments, the canopy cargo door 302 may be flush with the canopy top 312 when the canopy cargo door 302 is in the closed position. In other embodiments, a canopy cargo door such as the canopy cargo door 302 may be situated to move athwartships between open and closed positions.

Figure 4:
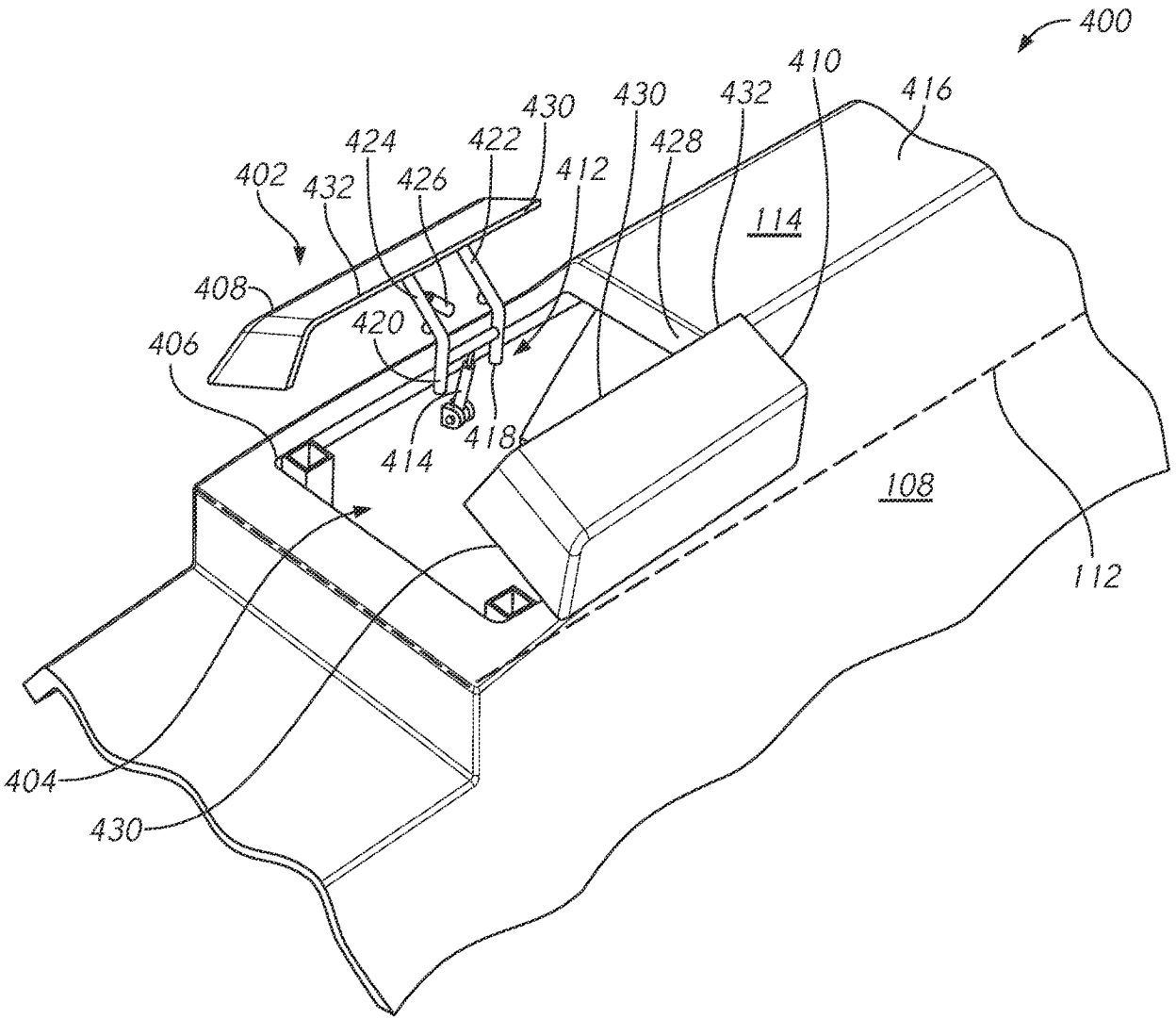
FIG. 4 shows a tall modular cargo bay canopy with a cargo bay door in a partially open configuration.

FIG. 4 shows a tall modular canopy 400 including a cargo door opening 404 selectively closeable by a hinged, multiple portion canopy cargo door 402. The cargo door opening 404 is defined by a cargo door jamb or coaming 406, which, like cargo door coaming 308, may be provided as an internal edge of the canopy top 416 of the tall modular canopy 400.

The canopy cargo door 402 includes a canopy cargo door port portion 408 and a canopy cargo door starboard portion 410. The canopy cargo door port portion 408 and the canopy cargo door starboard portion 410 are moveable between open and closed positions via a door actuation system 412 associated with each respective door portion. The door actuation system 412 may include for each canopy cargo door port portion 408 and canopy cargo door starboard portion 410 a fore hinge 418 and an aft hinge 420 provided at ends of respective fore swing arm 422 and aft swing arm 424. The ends of the fore swing arm 422 and aft swing arm 424 opposite the ends associated with the fore hinge 418 and aft hinge 420 attach to the canopy cargo door port portion 408 or canopy cargo door starboard portion 410. In the closed position, the fore swing arm 422 and aft swing arm 424 drop down into the cargo bay 116 and are thus concealed by the canopy top 416 and the canopy cargo door 402.

The respective canopy cargo door port portion 408 and canopy cargo door starboard portion 410 are movable between open and closed positions by a powered door actuator 414 and/or a manual door actuator 426. The powered door actuator 414 may be provided as a linear operator such as a hydraulic or pneumatic piston, a power screw, or other appropriate actuator. The manual door actuator 426 may be provided as a handle to enable manual movement of the canopy cargo door port portion 408 and or the canopy cargo door starboard portion 410. The powered door actuator 414 and/or the manual door actuator 426 may cause the canopy cargo door port portion 408 and/or the canopy cargo door starboard portion 410 to pivot relative to the tall modular canopy 400 between open and closed positions.

In some embodiments, a door actuation system may be associated with a removable canopy, such that removal of the canopy from the hull removes the cargo door and a portion of the door actuation system from the boat. In some embodiments, a portion of a door actuation system is common between the multiple canopies and can be connected to each canopy (e.g., a canopy door) as desired. For example, a short modular canopy 300 may have a door actuation system including an actuator such as a motor to actuate the cargo canopy door 302. A tall modular canopy may be provided with a door substantially similar to the cargo canopy door 302 adapted to accept the motor used to operate the cargo canopy door 302. In some embodiments, a portion of a door actuation system may remain attached to the boat 100 when a canopy is removed, and another portion of the door actuation system may be removed with the canopy. Continuing the example above, the door actuation system for the door 302 may accept a driver such as a splined shaft, chain, belt, or the like driven by a motor mounted to the boat 100. When the short modular canopy 300 is removed from the boat, the motor and/or driver may remain attached to the boat 100, while the balance of the door actuation system is removed with the short modular canopy 300. A tall modular canopy with a door similar to door 302 may be placed on the boat 100 and may accept the driver (e.g., shaft, chain, belt, or the like) to operate the door. The canopy cargo door port portion 408 and canopy cargo door starboard portion 410 shown are substantially the same size, such that the internal edges 432 where they meet when in the closed position form a split line substantially about a midline of the boat 100. In other embodiments, the canopy cargo door port portion 408 and the canopy cargo door starboard portion 410 may be different sizes and the split line formed by their respective internal edges 432 may be located to the starboard or port of a midline of the boat 100. In other embodiments, the canopy cargo door port portion 408 and the canopy cargo door starboard portion 410 may be arranged to open to the fore or aft of the boat 100, such that a split line where their respective internal edges 432 meet runs athwartships.

The cargo door coming 406 may provide an opening sealing interface 428 that may cooperate with a door sealing interface 430 associated with an edge of one or both canopy cargo door port portion 408 and canopy cargo door starboard portion 410 to seal the cargo bay 116 against ingress of contaminants, such as seawater and to conceal the cargo from observation. In some embodiments, the canopy cargo door port portion 408 and canopy cargo door starboard portion 410 may have complementary door sealing interfaces 430 that seal the door portions to one another. In some embodiments, the canopy cargo door port portion 408 and canopy cargo door starboard portion 410 may overlap one another in a closed position, such as for sealing purposes. In such embodiments, one of the canopy cargo door port portion 408 or the canopy cargo door starboard portion 410 may open before the other of the canopy cargo door port portion 408 or canopy cargo door starboard portion 410, in a staged fashion. In some embodiments, one of the canopy cargo door port portion 408 or the canopy cargo door starboard portion 410 may include a channel to channel away water that may have entered the door sealing interface 430 between the door portions.

Any of the doors described herein may be used with any of the modular cargo bay canopies, as desired. For example, the canopy cargo door 302 is shown with a short modular canopy 300 and a canopy cargo door 402 is shown with a tall modular canopy 400. In various embodiments, a canopy cargo door 302 could be used with a tall modular canopy 400, or a canopy cargo door 402 used with a short modular canopy 300, as desired. Any of the doors described herein may be adapted for particular cargo types. For example, the canopy cargo door 302 may be more suitable for a cargo of people, while the canopy cargo door 402 may be more suitable for a vehicle payload.

FIG. 5A-FIG. 8B show embodiments of modular canopy interfaces. The interfaces are described with respect to interfacing a modular cargo bay canopy with a boat 100, however some or all of the elements of the interfaces may be applicable to interfacing door portions to one another, and/or doors or door portions to a modular cargo bay canopy.

Figure 5B:
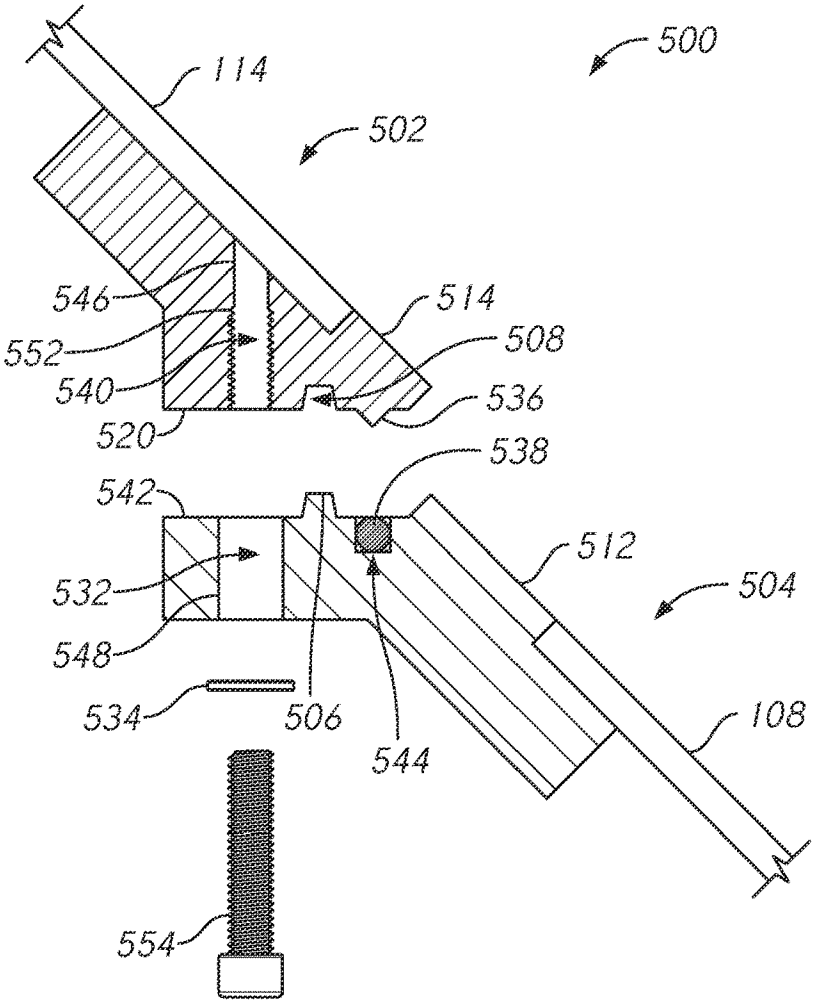
FIG. 5B shows a modular cargo bay canopy interface suitable for any modular cargo bay canopy disclosed herein, in a configuration uncoupled from a boat, according to one embodiment.
Figure 5A:
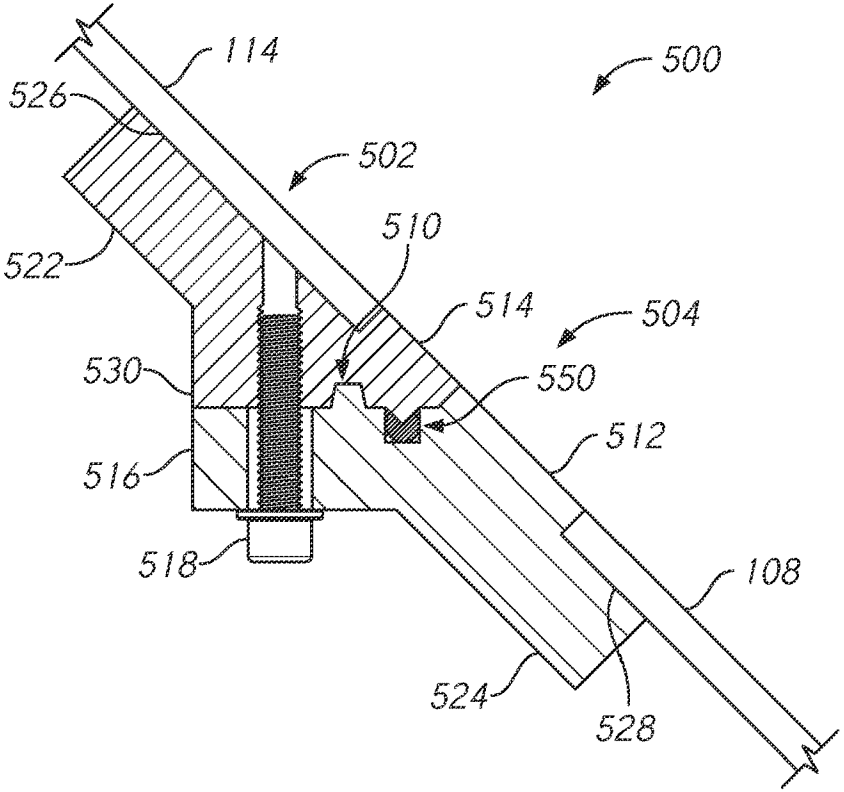
FIG. 5A shows a modular cargo bay canopy interface suitable for any modular cargo bay canopy disclosed herein, in a configuration coupled to a boat, according to one embodiment.

The embodiment of a modular canopy interface 500 shown, for example in FIG. 5A and FIG. 5B includes a first portion 504 associated with the hull and a second portion 502 associated with the canopy. In the second portion 502, a canopy interface element 514 is attached to the canopy wall 114 at a canopy wall joint 526. In the modular first portion 504, a complementary hull interface element 512 is attached to the hull 108 at a hull wall joint 528. The canopy interface element 514 includes a canopy attachment portion 522 that attaches to the canopy wall 114 opposite the canopy wall joint 526 from the canopy wall 114. Likewise, the hull interface element 512 includes a hull attachment portion 524 that attaches to the hull 108 opposite the hull wall joint 528. Thus, the canopy wall joint 526 and hull wall joint 528 attach the canopy attachment portion 522 to the canopy wall 114 and the hull attachment portion 524 to the hull 108, respectively. The canopy wall joint 526 and or the hull wall joint 528 may be formed by attaching the canopy interface element 514 to the canopy wall 114 or the hull interface element 512 to the hull 108, respectively, by any suitable mechanism, including adhesives; hook and loop fasteners; welding; soldering; brazing; or mechanical fasteners such as rivets, screws, bolts, or the like. In various embodiments, the canopy wall joint 526 and or hull wall joint 528 may selectively or permanently attach the canopy interface element 514 to the canopy wall 114 and the hull interface element 512 to the hull 108, respectively. In some embodiments, the canopy interface element 514 may be integrally formed with the canopy wall 114 and the hull interface element 512 may be integrally formed with the hull 108, such as by permanent attachment. In some embodiments, the canopy interface element 514 may be unitarily formed with the canopy wall 114 and the hull interface element 512 may be unitarily formed with the hull 108, such as by molding, casting, subtractive manufacturing (i.e., machining), additive manufacturing (i.e. 3D printing), or the like.

The canopy interface element 514 includes a canopy mating face 520 that cooperates with a hull mating face 542 of the hull interface element 512. The canopy interface element 514 includes an indexing recess 508 that extends away from the canopy mating face 520 into the body of the canopy interface element 514. The indexing recess 508 may be provided as shown, as a groove with a trapezoidal cross section. Other suitably shaped cross sections may be used, such as triangles, other regular polygons, or other irregular shapes. In the preferred embodiment, the indexing recess 508 is provided as a groove that runs along the canopy mating face 520, bending to cooperate with bends or changes in direction in the modular canopy interface 500. In some embodiments, the indexing recess 508 may run continuously around the periphery of the modular canopy interface 500. In other embodiments, the indexing recess 508 may be provided intermittently at certain locations around the periphery of the modular canopy interface 500.

The canopy interface element 514 includes a sealing protrusion 536 that extends out from the body of the canopy interface element 514 proud of the canopy mating face 520. The sealing protrusion 536 may be referred to as a sealing ridge or sealing or engagement member that surrounds the periphery of the modular canopy interface 500. The sealing protrusion 536 may be part of a sealing interface 550, as described in further detail below and in other descriptions herein. In some embodiments, the sealing protrusion 536 may be referred to as a "knife edge," and may, in some embodiments, have a pointed cross-section wherein the pointed cross-section forms a sharp edge or ridge configured to come into contact with, and apply focused pressure against, a resilient sealing element 538, as explained in further detail below and in other descriptions herein. In other embodiments, the sealing protrusion 536 may have a blunt or non-pointed cross-section, for example a rectangular, rounded, convex, concave, or other suitable profile compatible with a resilient sealing element 538 and/or sealing gland 544 Preferably, the sealing protrusion 536 extends continuously around the periphery of the modular canopy interface 500, however, in some embodiments, the sealing protrusion 536 may be intermittent.

In some embodiments of modular canopy interfaces, the interface may have multiple sealing interfaces spaced apart from one another transversely or longitudinally. For example, a modular canopy interface may have a first sealing interface 550 (e.g., including a sealing gland 544, a resilient sealing element 544, and sealing protrusion 536) located near the outer periphery of the modular canopy interface. A second sealing interface 550 may be located inboard relative to the first sealing interface 550. Additional sealing interfaces 550 may be used as desired. In various embodiments, an indexing protrusion 506 and indexing recess 508 may be located outboard from a sealing interface 550, inboard of a sealing interface 550, or between sealing interfaces 550 (e.g., when more than one sealing interface 550 is used). Such multiple sealing interfaces may be advantageous to provide redundancy and maintain sealing of the canopy in case of leaking or failed seals, such as may occur due to debris infiltration, wear, damage, corrosion, misalignment, manufacturing tolerances or the like.

The hull interface element 512 includes a sealing gland 544. The sealing gland 544 may be provided as a groove or trough that extends inward from the hull mating face 542 into the body of the indexing recess 508. The sealing gland 544 may extend around the periphery of the modular canopy interface 500 in a complementary fashion to the sealing protrusion 536. The sealing gland 544 may be provided as a retaining groove, channel, or depression within the body of the hull interface element 512 and may hold the resilient sealing element 538 in place. The example of a sealing gland 544 shown has a rectangular cross section, although other suitable cross sections are contemplated, as suitable to receive and seal in cooperation with the sealing protrusion 536 and/or a resilient sealing element 538. A resilient sealing element 538, such as an o-ring, rubber seal, flexible plastic seal, gasket, or similar structure, may extend around the periphery of the modular canopy interface 500 such as by being received in the sealing gland 544.

A sealing interface 550 of any embodiment of a modular canopy interface may be designed for desired levels of ingress protection. In some embodiments, the sealing interface 550 may be fluid-tight, such that fluids (e.g., gases or liquids) do not pass through the sealing interface 550. In some embodiments, a sealing interface 550 may be weather tight, sealing out splashing water and heavy precipitation, while not being completely fluid tight (e.g., allowing some gas or possibly some small amount of liquid to pass through). In various examples, the sealing interface 550 may be dust protected and protected against raindrops. In some embodiments, a sealing interface may be dust protected and/or protected against water jets from any angle. In some embodiments, a sealing interface 550 may be dust tight and/or protected against water jets from any angle. In some embodiments, a sealing interface 550 may be dust tight and/or protected against powerful water jets and heavy seas. In other embodiments, the sealing interface may be dust tight and/or protected against temporary or permanent immersion in water, respectively.

The hull interface element 512 includes a hull mating face 542 that mates with the canopy mating face 520 of the canopy interface element 514 when a modular cargo bay canopy is installed on the boat 100. The canopy mating face 520 includes an indexing protrusion 506 that extends out from the body of the hull interface element 512 proud of the hull mating face 542. As shown, the indexing protrusion 506 has a substantially trapezoidal cross section that complements and is adapted to be received in the indexing recess 508 when a modular cargo bay canopy is installed on the boat 100. As described herein, with respect to the indexing recess 508, other shaped cross sections may be used, to complement the indexing recess 508. An indexing protrusion 506 can be a continuous protrusion that extends along all or part of the periphery of a modular canopy interface. In other embodiments, indexing protrusions 506 may be discontinuous, such as teeth, posts, pins, wedges, bosses, or the like that are shaped and located to cooperate with complementary indexing recesses 508 to locate a canopy relative to the hull 108. Likewise, the indexing recess 508 may be a trough or channel that extends along all or part of the periphery of a modular canopy interface. The indexing recesses 508 may be discontinuous, such a plurality of holes, apertures, depressions, troughs, channels or the like that are shaped and located to cooperate with complementary indexing protrusions 506 to locate a canopy relative to the hull 108.

Together, the indexing protrusion 506 and indexing recess 508 may together form an indexing feature 510 that helps locate or align a modular cargo bay canopy with the boat 100 and to increase the rigidity of the modular canopy interface 500 which may help keep a sealing interface 550 intact. The indexing feature 510 may locate and/or fix the relative positions of a canopy and the hull such that the canopy and hull meet at a split line forming a substantially flush surface. For example, any modular canopy interface described herein may include an indexing protrusion 506 that when received in the indexing recess 508, sets the location of the outer surface of a hull interface element 512, 612, 712 relative to a canopy interface element 514, 614, 714 such that the respective elements meet at a split line so the outer surfaces of the hull and canopy interface elements are substantially flush. In other embodiments, of modular canopy interfaces, the indexing protrusion and indexing recess may set the relative locations of the hull interface element and the canopy interface element such that the canopy wall 114 and the hull 108 meet at a split line so the outer surfaces of the canopy wall and hull are substantially flush. In some embodiments, the indexing recess 508, the sealing protrusion 536, the indexing protrusion 506 and/or the sealing gland 544 may be located at different locations athwartships as they progress along straight portions of the modular canopy interface 500. For instance, these elements may undulate or zig-zag to the port or starboard, up or down, or fore or aft as they progress along the periphery of the modular canopy interface 500. In other embodiments, the features may be located more to the starboard or port sides of the boat at a fore location and more to the other of the starboard or port sides at an aft location on the boat 100, thereby gradually tapering from port to starboard or starboard to port as they extend along the modular canopy interface 500. Such changing port or starboard locations may have the advantage of more positively aligning a modular cargo bay canopy with the boat 100. In various embodiments, a modular canopy interface may include one or more sealing interfaces 550 and/or one or more indexing features 510.

When a modular cargo bay canopy is installed on a boat 100, such as is shown in FIG. 5A, FIG. 6A, FIG. 7A, or FIG. 8, the indexing protrusion 506 may be received in the indexing recess 508 to align, lock, or fix the position of the modular cargo bay canopy relative to the boat 100. Similarly, the sealing protrusion 536 may be at least partially received within the sealing gland 544 thereby compressing and sealing against the resilient sealing element 538. As shown, the sealing protrusion 536 may elastically deform the resilient sealing element 538, pressing into and displacing material of the resilient sealing element 538 causing it to conform to the shape of the cavity formed by the sealing protrusion 536 and the sealing gland 544.

The relative arrangements of the indexing protrusion 506, indexing recess 508, sealing protrusion 536, and sealing gland 544 may vary from the arrangement shown in the figures. In various embodiments, the indexing protrusion 506, indexing recess 508, sealing protrusion 536, and sealing gland 544 may be disposed on either of the canopy mating face 520 or the hull mating face 542. Further, the indexing protrusion 506 and indexing recess 508 may be either inboard with respect to the sealing protrusion 536 and sealing gland 544, or they may be outboard. In some embodiments, one or more of the indexing protrusion 506, indexing recess 508, sealing protrusion 536, and sealing gland 544 may be optional. In some embodiments, any of the indexing protrusion 506, indexing recess 508, sealing protrusion 536, and sealing gland 544 may have cross sectional shapes that vary or are different along different portions of the modular canopy interface 500.

The canopy interface element 514 may include a canopy flange portion 530 extending inwardly toward in interior of a modular cargo bay canopy. The canopy flange portion 530 may be provided with various fastening features to enable the selective attachment of the modular cargo bay canopy to the boat 100 via the modular canopy interface 500. In the embodiment shown, the canopy flange portion 530 includes a fastener engagement aperture 540. The aperture 540 may be a through hole extending through the canopy attachment portion 522 and terminating at an inner face of the canopy wall 114, or it may be a blind hole terminating within the body of the canopy attachment portion. The canopy fastener internal wall 546 may have helical internal threads 552 formed therein for cooperative engagement of cooperating external threads 554 of a fasteners 518.

The hull interface element 512 may include a hull flange portion 516 extending inwardly toward an inner part of the cargo bay 116. The hull flange portion 516 may include a fastener clearance aperture 532 defined by a hull fastener internal wall 548. The fastener clearance aperture 532 may have a diameter sufficiently large to allow a fastener 518 to pass through without touching the hull fastener internal wall 548. In some embodiments, the hull fastener internal wall 548 may include internal threads similar to the internal threads 552 to engage the fastener 518. To secure a tall modular cargo bay canopy to the boat 100, a fastener 518 may be inserted through the fastener clearance aperture 532 and rotated such that the external threads 554 engage with the internal threads 552 to draw the fastener 518 into the fastener engagement aperture 540. The fastener 518 may be tightened to a sufficient torque to provide an adequate sealing force to hold the modular cargo bay canopy to the boat 100 and sufficiently compress the resilient sealing element 538 to seal the canopy from the environment. A load bearing element such as a washer 534 may be disposed adjacent to a head of the fastener 518 to transfer the tensile stress developed in the fastener 518 as a result of tightening to the hull interface element 512, thereby holding the modular cargo bay canopy to the boat 100. A plurality of fasteners 518, fastener engagement apertures 540 and fastener clearance apertures 532 may be disposed at various locations along the periphery of the modular canopy interface 500 to adequately couple a modular cargo bay canopy to the boat 100.

Figure 6B:
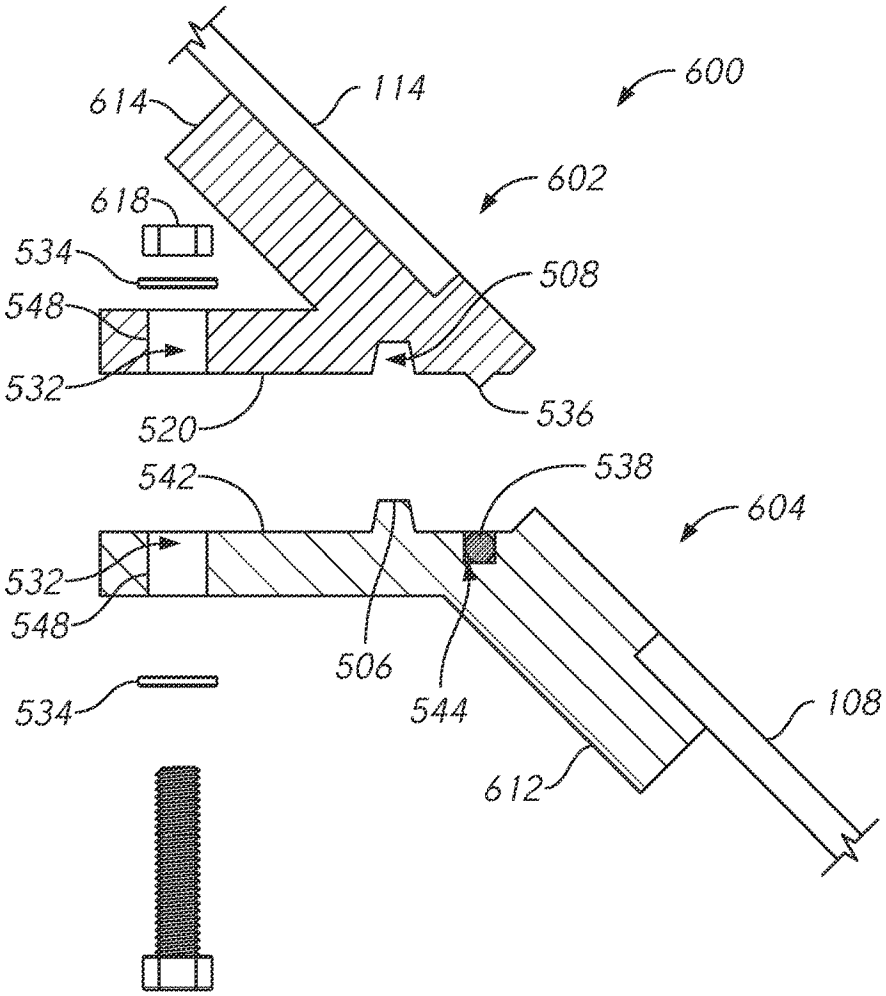
FIG. 6B shows a modular cargo bay canopy interface suitable for any modular cargo bay canopy disclosed herein, in a configuration uncoupled from a boat, according to one embodiment.
Figure 6A:
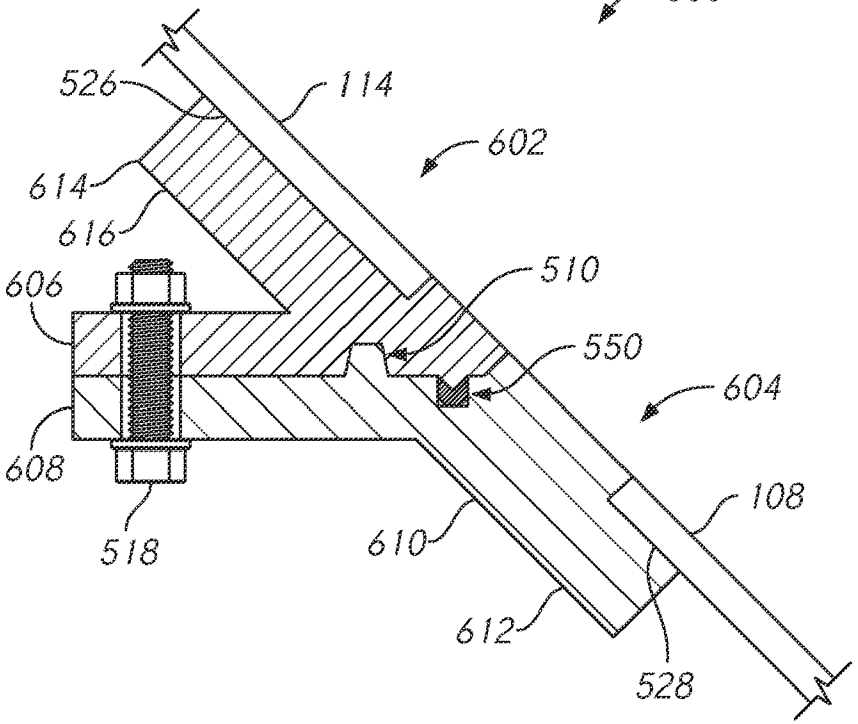
FIG. 6A shows a modular cargo bay canopy interface suitable for any modular cargo bay canopy disclosed herein, in a configuration coupled to a boat, according to one embodiment.

FIG. 6A and FIG. 6B show a modular canopy interface 600 with an alternate mechanism for attaching a modular cargo bay canopy to the boat 100 from the modular canopy interface 500. The modular canopy interface 600 includes a first portion 604 associated with the hull and a second portion 602 associated with a canopy. Similar features to the modular canopy interface 500 are similarly numbered and are not discussed again, for brevity. Such numbered features may be as described with respect to the modular canopy interface 500. The modular canopy interface 600 includes a canopy interface element 614 and a hull interface element 612. The canopy interface element 614 includes a canopy attachment portion 616 that attaches to the canopy wall 114 via a canopy wall joint 526 as previously described with respect to the canopy attachment portion 522. Similarly, the hull interface element 612 includes a hull interface element 610 that attaches to the hull 108 via a hull wall joint 528 as described with respect to the hull attachment portion 524.

The canopy interface element 614 and hull interface element 612 include respective canopy flange portion 606 and a hull flange portion 608. The canopy flange portion 606 extends into the interior of the modular cargo bay canopy, and the hull flange portion 608 extends into the interior of the cargo bay 116. In this embodiment, both the canopy flange portion 606 and the hull flange portion 608 include fastener clearance apertures 532 defined by respective hull fastener internal walls 548. A fastener 518 may pass through both the fastener clearance apertures 532, extending through the canopy flange portion 606 and the hull flange portion 608 to engage a nut 618 positioned on an opposite flange portion from the head of the fastener 518. As with the modular canopy interface 500, load bearing elements such as washers 534 may spread or transfer the load bearing stress developed in a tightened fastener 518.

Figure 7B:
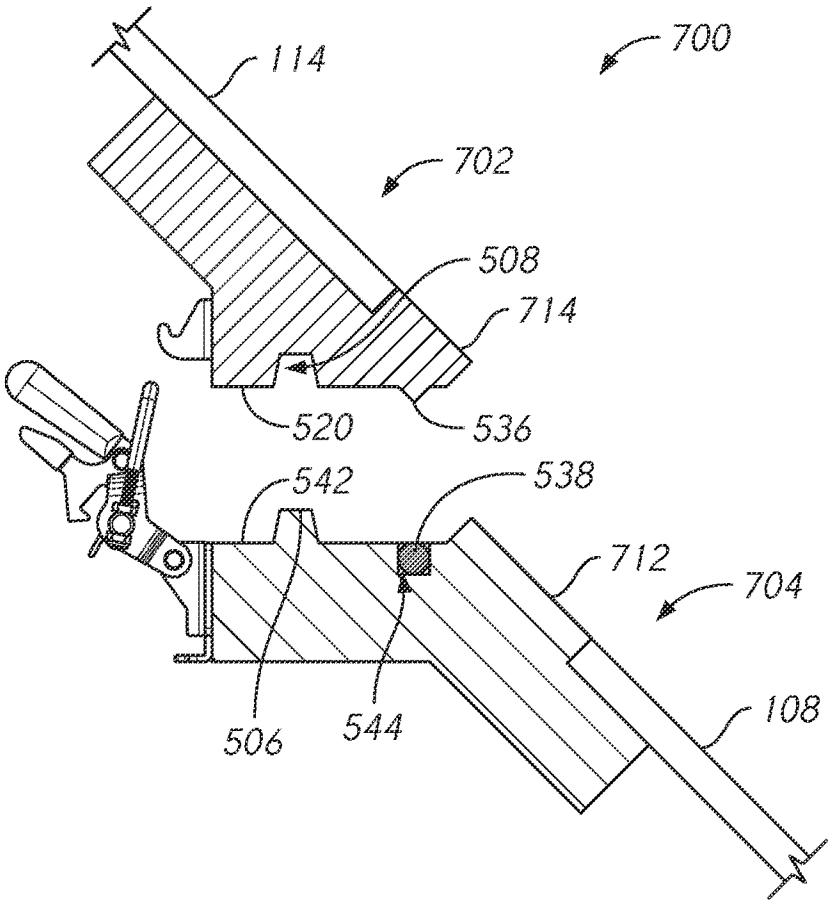
FIG. 7B shows a modular cargo bay canopy interface suitable for any modular cargo bay canopy disclosed herein, in a configuration uncoupled from a boat, according to one embodiment.
Figure 7A:
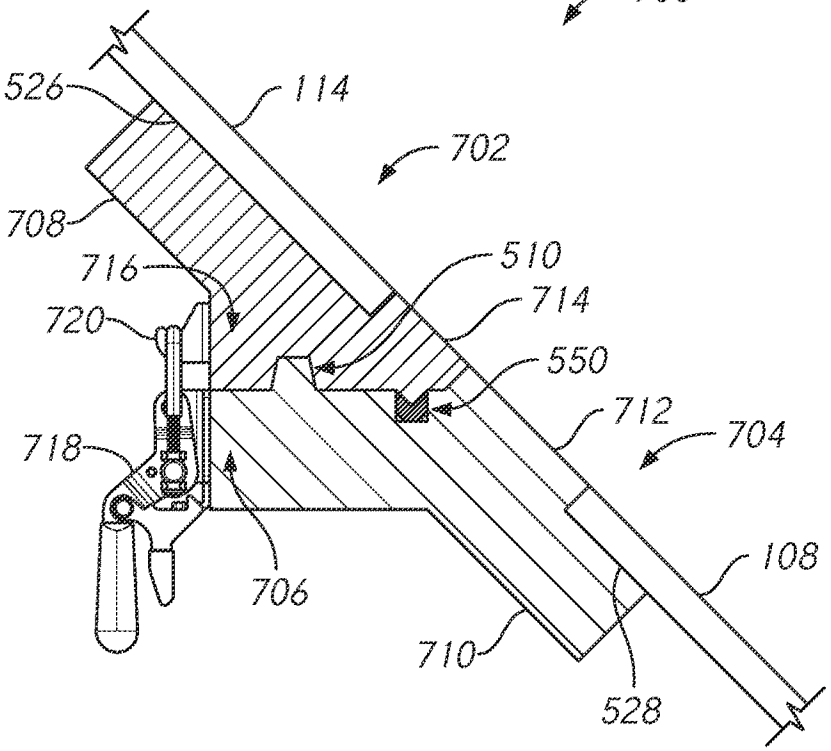
FIG. 7A shows a modular cargo bay canopy interface suitable for any modular cargo bay canopy disclosed herein, in a configuration coupled to a boat, according to one embodiment.

FIG. 7A and FIG. 7B show a modular canopy interface 600 with an alternate mechanism for attaching a modular cargo bay canopy to the boat 100 from the modular canopy interface 500 and the modular canopy interface 600. The modular canopy interface 700 includes a first portion 704 associated with the hull and a second portion 702 associated with a canopy. The modular canopy interface 700 includes a hull interface element 712 and a canopy interface element 714. The hull interface element 712 attaches to the hull 108 via a hull attachment portion 710 and a hull wall joint 528 as previously described. Likewise, the canopy interface element 714 attaches to a modular cargo bay canopy via a canopy attachment portion 708 and a canopy wall joint 526 as previously described. The hull interface element 712 includes a hull flange portion 706 that includes a clasp 718 operative to selectively releasably engage a hook 720 located on the canopy flange portion 716 of the canopy interface element 714. The modular canopy interface 700 may have several advantages relative to the modular canopy interface 500 or the modular canopy interface 600. For example, the hook 720 may be affixed to the canopy flange portion 716, and the clasp 718 may be affixed to the hull flange portion 706. This may prevent fasteners from being lost, misplaced, or vibrating loose. Also, the clasp 718 and hook 720 of the modular canopy interface 700 take guess work out of providing the proper torque to a fastener 518 and or a nut 618, allowing for a set it and forget it type of fastening with uniform clamping force applied at all such clasps 718 and hooks as may be disposed along the modular canopy interface 700. The clasp 718 and hook 720 arrangement may allow a modular cargo bay canopy to be attached or removed from the boat 100 without the use of tools, as the clasp 718 may be manually operated by a user's hands. Further, a clasp 718 and hook 720 may be faster to attach relative to a threaded fastener arrangement as in the modular canopy interface 500 and the modular canopy interface 600.

Certain embodiments of modular canopy interfaces may include attachment mechanisms from any or all of the modular canopy interface 500, the modular canopy interface 600, or the modular canopy interface 700. For instance, a modular cargo bay canopy could use bolted fasteners of the modular canopy interface 500 at high stress locations such as corners, near doors, or other transitions, while using the clasp 718 and hook 720 arrangement of the modular canopy interface 700 elsewhere.

Figure 8B:
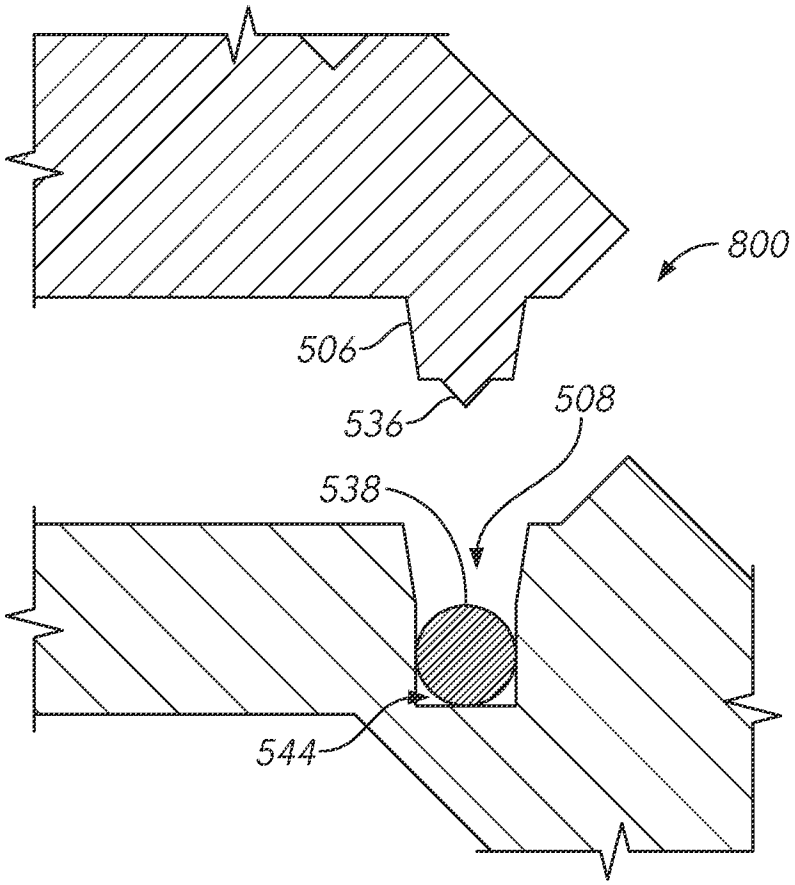
FIG. 8B shows a modular cargo bay canopy interface suitable for any modular cargo bay canopy disclosed herein, in a configuration uncoupled from a boat, according to one embodiment.
Figure 8A:
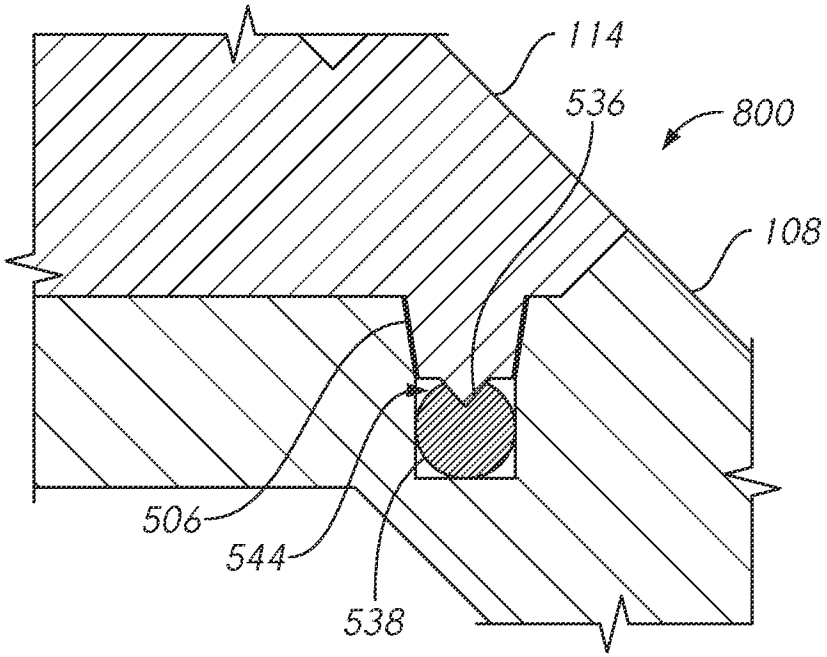
FIG. 8A shows a modular cargo bay canopy interface suitable for any modular cargo bay canopy disclosed herein, in a configuration coupled to a boat, according to one embodiment.

In some embodiments, as shown for example in FIG. 8, a sealing interface 800 includes an indexing protrusion 506 combined or included with a sealing protrusion 536 in a single feature. Likewise, an indexing recess 508 and a sealing gland 544 may be combined in a single groove. The indexing protrusion 506 and sealing protrusion 536 may be adapted to simultaneously, respectively engage the indexing recess 508 and the sealing gland 544 and/or resilient sealing element 538. Such an arrangement may have the benefit of being cheaper to manufacture and may be more robust.

When coupled as shown in FIG. 5A and FIG. 7A, the hull interface element 512 and canopy interface element 514 may meet at a split line forming a substantially flush surface to prevent faces or features that might increase the reflectivity or observability of the boat 100 to various sensing technologies such as radar. Similarly, as shown for example in FIG. 6A. In any embodiment of a modular canopy interface, the respective hull interface elements and canopy interface elements may meet to at a split line at the external surface of the boat 100, forming a substantially flush surface (e.g., interfaces 500, 600, 700, and 800). Alternately, in any embodiment of a modular canopy interface, the respective hull interface elements and canopy interface elements may be covered by the canopy wall 114 and/or the hull 108. (e.g., interfaces 600 and 800). For example, the canopy interface element and hull interface element may be disposed internally to the modular cargo bay canopy and the cargo bay respectively, and the canopy wall 114 and hull 108 meet at a split line forming a substantially flush surface. The term flush or substantially flush implies that the distinct surfaces that meet at a flush interface are substantially co-planar across the interface so as to reduce or eliminate any perceivable steps or other discontinuities across the interface. In the embodiments shown, the split line extends perpendicularly to the external faces of the respective hull interface elements 512, 612, 712, canopy interface elements 514, 614, 714, the canopy wall 114, and/or hull 108. In other embodiments, the split line may extend at angles other than perpendicularly to the respective hull interface elements 512, 612, 712, canopy interface elements 514, 614, 714, the canopy wall 114, and/or hull 108. In some embodiments, the split line where the hull 108 and the canopy all 114 meet may be located downward, relative to the sealing interface 550 such that a modular cargo bay canopy can rest when not installed on a boat 100 on an edge of the canopy wall 114 rather than with the sealing protrusion 536 in contact with the ground or other support surface. This arrangement may have the advantage of protecting the sealing protrusion 536 from damage, corrosion or contamination when being stored. The split line may be located as low as a main deck of the boat 100.

Various examples of the present disclosure have been described in detail above to facilitate an understanding of the invention. It will be recognized by those skilled in the art that many variations to the examples described are possible without departing from the scope and spirit of the invention disclosed herein, and that the scope of the claimed invention is defined by the claims listed below. The terms "including" and "having" as used in the specification and claims shall have the same meaning as the term "comprising."

What is claimed is:

1. A watercraft comprising:

a hull defining a hull cavity;

a canopy interface comprising a first portion fixed to the hull and terminating at an interface opening that provides access into the hull cavity; and a canopy removably coupled to the hull via the canopy interface, wherein the canopy defines an access opening that provides access into the hull cavity, and wherein the canopy comprises a canopy wall surrounding the access opening and which is configured to be removably coupled to the first portion to enclose and seal the interface opening, the canopy interface being configured to interchangeably couple any one of a plurality of different canopies, including the canopy, to the hull, each canopy of the plurality of different canopies having a different canopy wall that extends to a different height above or below a deck of the watercraft thereby providing a different outer profile.

2. The watercraft of claim 1, wherein the canopy is configured to enclose cargo that rises vertically above the first portion when the cargo is disposed within the hull cavity.

3. The watercraft system including the watercraft of claim 1, wherein the canopy is a first canopy, the watercraft system further comprising a second canopy of the plurality of different canopies removably interchangeably attachable to the hull via the canopy interface in place of the first canopy, the second canopy having a roof having a height below a roof of the first canopy.

4. The watercraft system of claim 3, wherein the first canopy accommodates a manned vehicle, and wherein the second canopy accommodates a person but not the manned vehicle.

5. The watercraft of claim 1, wherein the canopy interface is configured to align the canopy to the hull such that an outer surface of the canopy wall is substantially flush with an outer surface of the first portion when the canopy is coupled to the hull.

6. The watercraft of claim 5, wherein the canopy interface comprises:

a first mating face on the first portion;

a second mating face on the canopy wall opposite the first mating face;

an indexing protrusion on one of the first and second mating faces; and an indexing recess on the other one of the first and second mating faces.

7. The watercraft of claim 6, wherein the canopy interface further comprises a seal including a resilient sealing element on one of the first and second mating faces and a sealing protrusion on the other one of the first and second mating faces.

8. The watercraft of claim 7, wherein the resilient sealing element is located within the indexing recess and wherein the sealing protrusion is provided by or extends from the indexing protrusion.

9. The watercraft of claim 5, wherein the first portion comprises an first indexing feature extending along a portion of a periphery of the interface opening and configured to cooperate with a second indexing feature of the canopy wall to align the canopy, the canopy interface further comprising a seal extending along a portion of a periphery of the interface opening such that the first indexing feature is between the interface opening and the seal.

10. The watercraft of claim 1, further comprising an air management system adapted to direct intake air to an engine room of the watercraft.

11. A watercraft of omprising:

a hull defining a hull cavity; and a canopy removably coupled to the hull via a canopy interface comprising a first portion fixed to the hull and a second portion fixed to the canopy, wherein the first portion defines an opening through the hull into the hull cavity, and wherein the second portion is configured to be removably coupled to the first portion to enclose and seal the opening whereby the canopy interface is configured to interchangeably couple any one of a plurality of different canopies, including the canopy, to the hull, each of the plurality of different canopies having a different configuration that provides a different access opening into the hull cavity or reconfigures the hull with a different outer profile, wherein the canopy comprises:

a cargo door that selectively seals a cargo door opening defined by the canopy; and a first door actuation system portion that selectively moves the first cargo door between an open position which provides access into the hull cavity and a closed position in which the cargo door seals the first cargo door opening, whereby removal of the canopy from the hull removes the cargo door and the first door actuation system portion from the watercraft.

12. The watercraft of claim 11, wherein the cargo door is adapted to allow a manned vehicle to pass through when the cargo door is in the open position.

13. The watercraft of claim 12, wherein the cargo door is a first cargo door, the canopy further comprising a second cargo door, wherein the door actuation system comprises respective first and second hinges about which the first cargo door and the second cargo door are rotatable to move between respective open and closed positions.

14. The watercraft of claim 13, wherein the first cargo door and the second cargo door include respective internal edges that meet along a split line when the first and second cargo doors are in the closed position.

15. The watercraft of claim 11, wherein the door actuation system includes a track oriented along a longitudinal axis of the watercraft such that the cargo door is slidable along the track between the open and closed positions.

16. The watercraft of claim 15, wherein the track is partially oriented along an upward axis of the watercraft such that the cargo door is translatable about the upward axis between the open and closed positions.

17. The watercraft of claim 11, wherein the first door actuation system portion cooperates with a second door actuation system portion attached to the watercraft to selectively move the first cargo door.

18. The watercraft of claim 1, wherein the second portion includes a metal interface and the first portion includes one of a metal interface or a composite interface.

19. The watercraft of claim 1, wherein the second portion includes a composite material interface and the first portion includes one of a metal interface or a composite interface.

20. The watercraft system of claim 1, wherein each of the first and second provides a different internal volume when coupled to the hull to seal the hull cavity.

* * * * *